US006526942B2

(12) United States Patent
Kuzuyama

(10) Patent No.: US 6,526,942 B2
(45) Date of Patent: Mar. 4, 2003

(54) COMMON RAIL TYPE FUEL INJECTING DEVICE

(75) Inventor: Hiroshi Kuzuyama, Aichi-ken (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 22 days.

(21) Appl. No.: 09/832,593

(22) Filed: Apr. 11, 2001

(65) Prior Publication Data

US 2001/0029926 A1 Oct. 18, 2001

(30) Foreign Application Priority Data

Apr. 20, 2000 (JP) ..... 2000-118944

(51) Int. Cl.[7] ..... F02M 37/04

(52) U.S. Cl. ..... 123/446; 123/506; 123/496; 123/501

(58) Field of Search ..... 123/456, 446, 123/447, 467, 506, 496; 239/88–96

(56) References Cited

U.S. PATENT DOCUMENTS 4,605,166 A * 8/1986 Kelly ..... 239/96
5,743,237 A * 4/1998 Matta ..... 123/496
6,173,699 B1 * 1/2001 Kasen ..... 123/446
6,213,093 B1 * 4/2001 Yudanov et al. ..... 123/446
6,408,829 B1 * 6/2002 Lei et al. ..... 123/501

FOREIGN PATENT DOCUMENTS

JP 10-018934 1/1998 ..... F02M/51/06
JP 10-110658 4/1998 ..... F02M/47/00

* cited by examiner

*Primary Examiner*—Thomas N. Moulis
(74) *Attorney, Agent, or Firm*—Morgan & Finnegan, LLP

(57) ABSTRACT

In a pressure increasing type injector, a fuel pressure increasing chamber is communicated via a pressure relief passage, a recessed portion, a communication hole, a hollow portion and a bypass passage with a pressure release portion. A ball valve disposed within the recessed portion interrupts the communication between the recessed portion and the pressure relief passage at the start of fuel injection, and communicates the recessed portion with the pressure relief passage at the end of the fuel injection. Consequently, an injection ratio is increased gently at the start of the injection, and the fuel within the fuel pressure increasing chamber flows out therefrom to a pressure release portion when the valve is closed. Accordingly, an injection port can be closed rapidly and therefore the injection ratio is lowered abruptly.

6 Claims, 9 Drawing Sheets

COMMON RAIL TYPE FUEL INJECTING DEVICE

BACKGROUND OF THE INVENTION

The present invention relates to a common rail type fuel injecting device.

DESCRIPTION OF THE RELATED ART

Recently, a common rail type fuel injecting device is focussed on in a diesel engine technology. The common rail type fuel injecting device is designed such that high pressure operation fluid charged in a common rail is transmitted therefrom to an injector to thereby activate the injector with the operation fluid.

As the injector, the following types have been proposed. One type is a pressure charging type that injects a fuel which has been pressure-increased to a predetermined pressure preliminarily, and another type is a pressure increasing type which injects a fuel while increasing the pressure thereof during injection. For example, the pressure charging type injector is disclosed in Japanese Patent Application Laid-open No.10-18934, and the pressure increasing type injector is disclosed in Japanese Patent Application Laid-open NO.10-110658.

The pressure charging type injector disclosed in Japanese Patent Application Laid-open No.10-18934 preliminarily increases the pressure of the fuel, and therefore, as shown in FIG. 8, the injection ratio is abruptly increased at the start of the fuel injection, and is abruptly lowered at the end of injection since the pressure of the pressure-increased fuel can be utilized.

The pressure increasing type injector disclosed in Japanese Patent Application Laid-open No.10-110658 is designed to control together two valves, i.e. a pin spool valve and an intensifier valve, using one electromagnetic solenoid. The pressure increasing type injector increases the pressure at the time of injection, and accordingly, as shown in FIG. 9, the increase in ratio of fuel injection at the start of the fuel injection is gentle, and since the pressure of the pressure increased fuel can not be used at the end of the injection, and an injection valve is closed only by a spring force of a return spring provided to the injection valve, so that the injection ratio is gently lowered.

These pressure charging type and pressure increasing type fuel injecting devices, however, suffer from a problem in that these devices can not put exhausted gas into an appropriate state, or the like.

In more detail, in view of engine characteristics, the fuel injection ratio is preferably increased gently rather than abruptly at the start of the fuel injection in order to suppress generation of nitrogen oxide, combustion noise and vibration, whereas the fuel injection ratio is preferably increased abruptly rather than gently at the end of the fuel injection in order to suppress generation of incompletely combusted fuel and particulate.

However, the pressure charging type increases the fuel injection ratio too abruptly at the start of the injection, and the pressure increasing type decreases the fuel injection ratio too gently at the end of the injection.

As described above, the pressure charging type and the pressure increasing type in the related art encounter the problems at either one of the start and end of the fuel injection.

For this reason, a fuel injection device has been required, which has characteristics of gently increasing the injection ratio at the start of the injection similarly to the pressure increasing type and abruptly decreasing the injection ratio at the end of the injection similarly to the pressure charging type, as shown in FIG. 10.

SUMMARY OF THE INVENTION

The present invention was made in view of the aforementioned problem. An object of the present invention is to provide a common rail type fuel injecting device, which can gently increase the injection ratio at the start of the fuel injection and abruptly decrease the injection ratio at the end of the fuel injection.

The present invention is directed to a common rail type fuel injecting device for an internal combustion engine, comprising: a common rail receiving operation fluid; and an injector having a pressure application chamber and a fuel pressure increasing chamber at both ends of a pressure increasing piston, in which at a start of fuel injection, the operation fluid charged in the common rail flows therefrom into the pressure application chamber to bias the pressure increasing piston and pressurize fuel within the fuel pressure increasing chamber, thereby injecting the fuel, whereas at an end of the fuel injection, the operation fluid within the pressure application chamber flows out therefrom to end pressure application to the fuel within the fuel pressure increasing chamber using the pressure increasing piston, thereby ending the fuel injection, said injector being provided with a passage through which the fuel within the fuel pressure increasing chamber flows out externally and switching means for interrupting communication of the passage at the start of the injection, and establishing the communication of the passage at the end of the injection.

DESCRIPTION OF THE PREFERRED EMBODIMENTS

Figure 1:
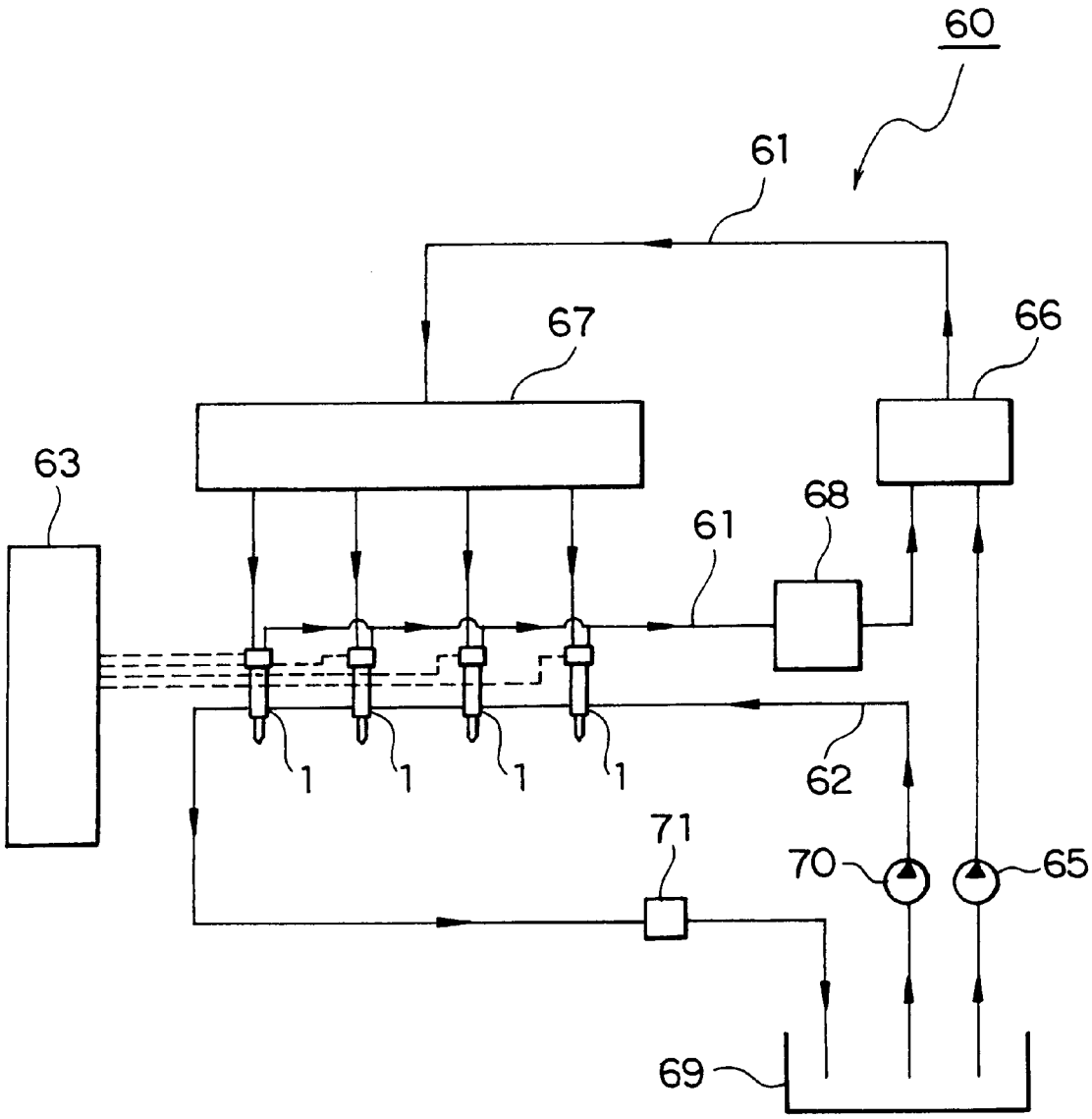
FIG. 1 is a schematic diagram showing a common rail type fuel injecting device with which a first embodiment of the present invention is explained.

Referring to the accompanying drawings, preferred embodiments of the present invention will be described.

Embodiment 1

A first embodiment which embodies the present invention as a common rail type fuel injecting device used in a diesel engine will be described with reference to FIGS. 1 to 4.

A common rail type fuel injection device 60 is provided with one or more of pressure increasing type injectors 1 (hereafter, simply referred to as the injectors), which are disposed within each cylinder head of an engine not shown. The fuel injection device 60 further includes an operation fluid circulating system 61 that supplies or recoveries fuel, serving as an operation fluid, to and from the injectors 1, a fuel supplying system 62 that supplies the fuel to the injectors 1, a computer 63 that controls electronically the injectors 1, and the like.

The operation fluid circulating system 61 has a fuel supplying pump 65, a high pressure pump 66, a common rail 67, an operation fluid recovering device 68 and the like. The fuel supplying pump 65 transmits the fuel within a fuel tank 69 to the high pressure pump 66 under pressure. The fuel is increased in pressure by the high pressure pump 66 to be transmitted to the common rail under pressure. The fuel thus transmitted to the common rail 67 under pressure is charged within the common rail 67, and is transmitted under pressure, at an appropriate timing, to an operation fluid supplying portion 2 (see FIG. 2) of the injector 1 as the operation fluid. The operation fluid recovering device 68 recoveries the fuel, i.e. the operation fluid, flowing out from a pressure release portion 3 (see FIG. 2) of the injector 1, and re-circulates the recoveried fuel to the high pressure pump 66.

The fuel supplying system 62 includes a pump 70 and a valve 71. The pump 70 transmits the fuel within the fuel tank 69 to fuel supplying portion 21 (see FIG. 2) of each injector 1 under pressure. The valve 71 adjusts the supply amount of the fuel supplied to the injectors 1.

The computer 63 generates control signals to control the respective injectors 1. The control signal in the present embodiment is to be supplied to an electromagnetic solenoid 4 (see FIG. 2) built in the injector 1.

Figure 2:
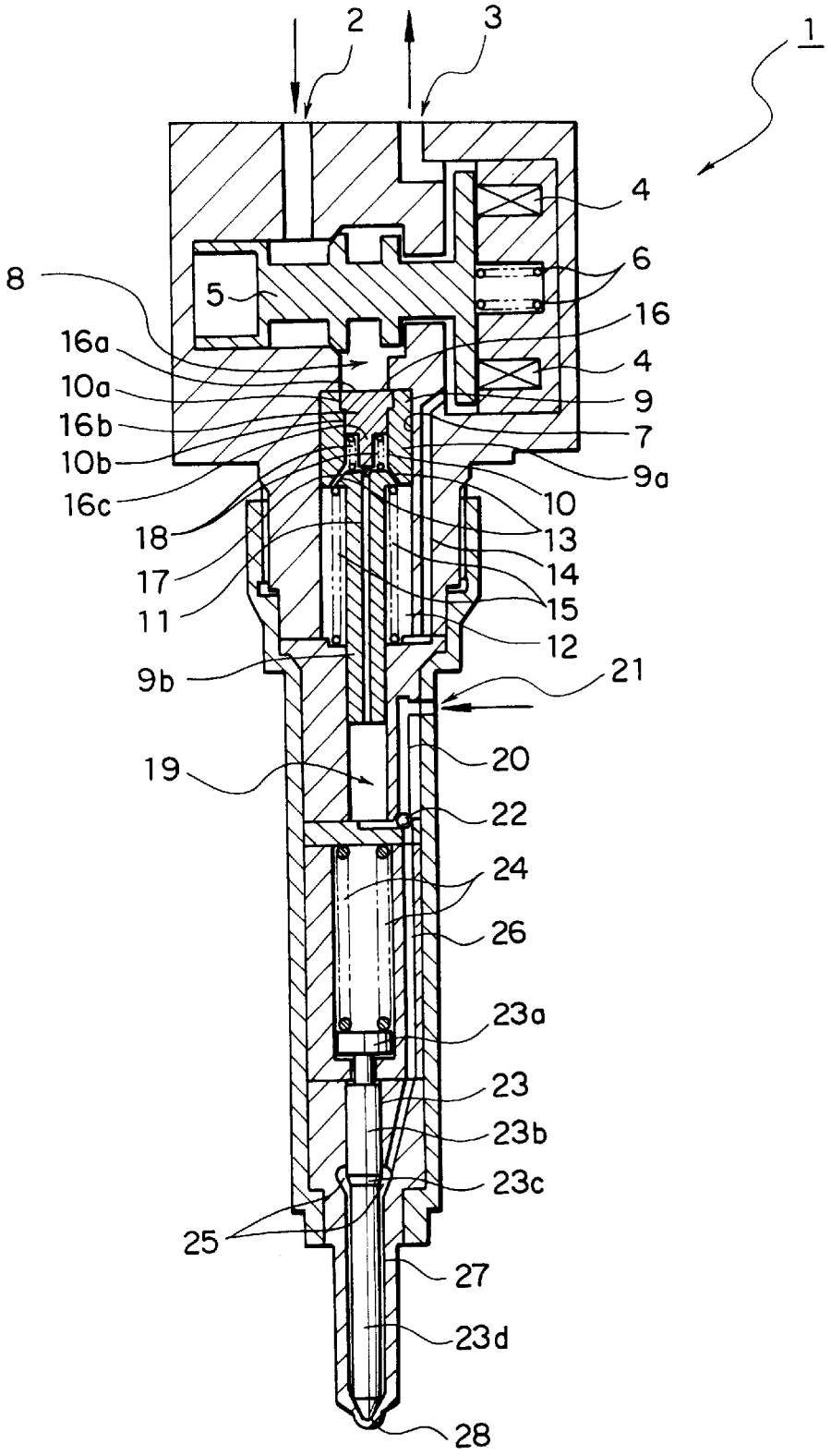
FIG. 2 is a sectional view of an injector, for explaining a state prior to the start of fuel injection.
Figure 3:
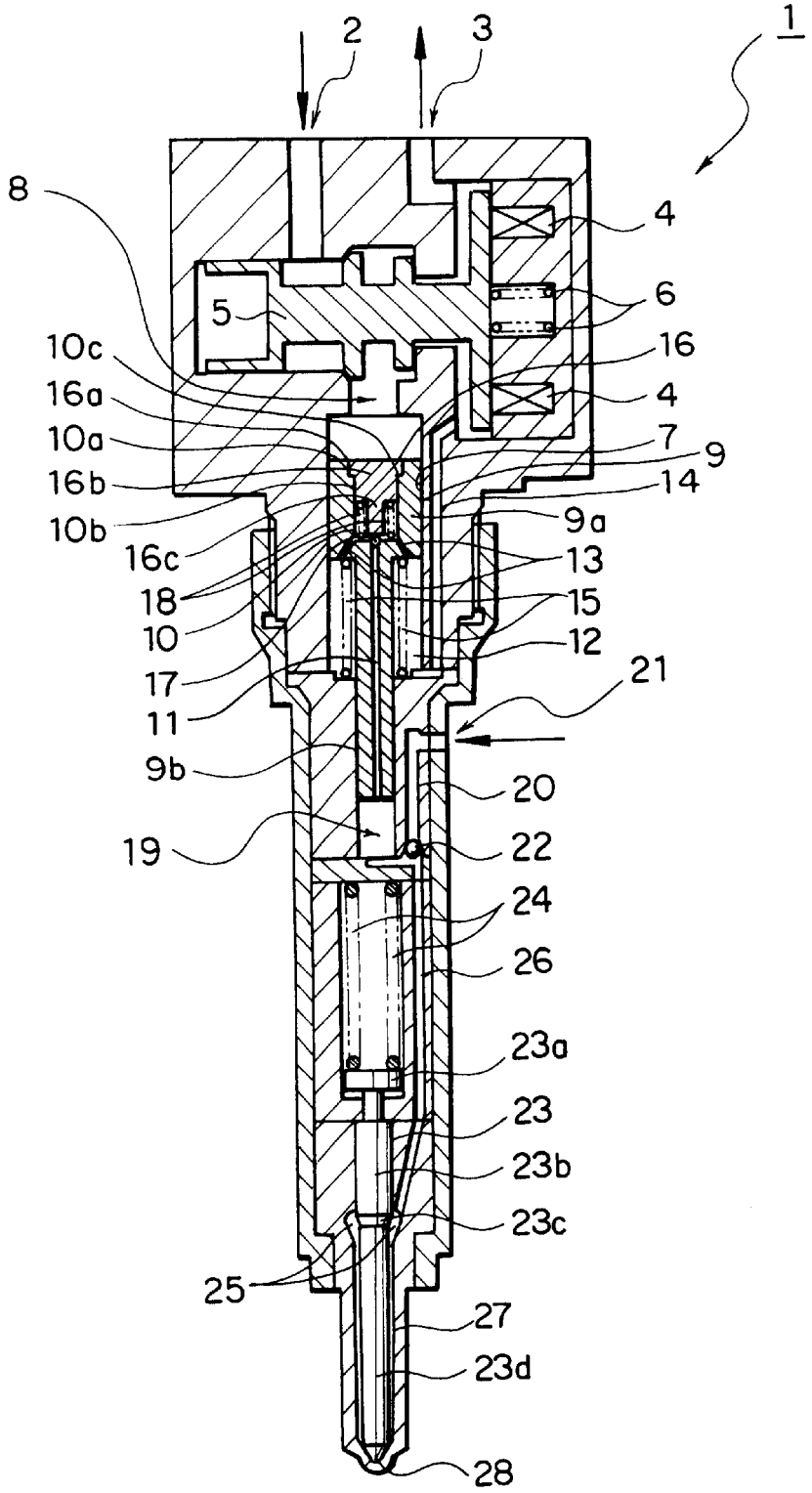
FIG. 3 is a sectional view of the injector, for explaining a state at the start of the fuel injection.
Figure 4:
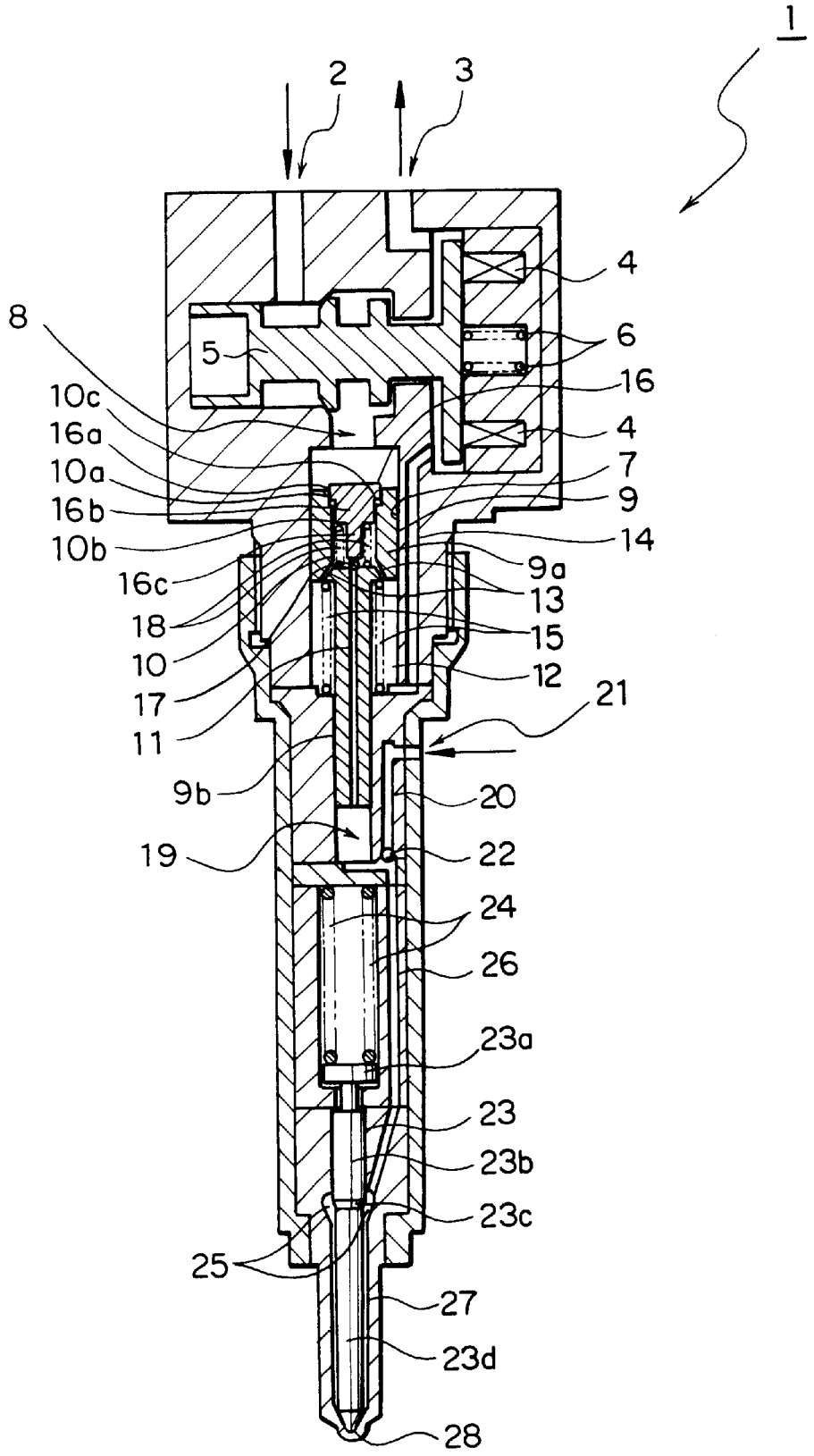
FIG. 4 is a sectional view of the injector, for explaining a state at the end of the fuel injection.

Next, a sectional view of the injector 1 is shown in FIGS. 2 to 4.

In the following description, terms such as "an upper end portion of the injector 1" indicating directions of the injector 1 will be used, but these terms are intended to describe the directions in the Figures, and therefore the directions may differ from directions when the injector 1 is mounted to an engine.

As shown in FIGS. 2 to 4, the operation fluid supplying portion 2 and the pressure release portion 3 are formed at an upper end portion of the injector 1. To the operation fluid supplying portion 2, the high pressure fuel, serving as the operation fluid, is supplied from the common rail 67 under pressure. The fuel, serving as the operation fluid, flows out from the pressure release portion 3 and is recoveried in the operation fluid recovering device 68.

An electromagnetic solenoid 4, a switch valve 5 and a return spring 6 are accommodated within an upper portion of the injector 1. The electromagnetic solenoid 4 is energized by a current that is a control signal supplied from the computer 63. The switch valve 5 is slidably attached to receive an attraction force from the energized electromagnetic solenoid 4, and to be biased by the return spring 6 in a direction away from the electromagnetic solenoid 4.

An accommodating chamber 7 is formed in a central portion of the injector 1. A pressure application chamber 8 is formed above the accommodating chamber 7 so that the pressure application chamber 8 is communicated with the accommodating chamber 7 as well as with the operation fluid supplying portion 2 and the pressure release portion 3. A pressure increasing piston 9 is accommodated vertically slidably within the accommodating chamber 7. The pressure increasing piston 9 is constructed by a guided rod portion 9*a* and a pressure increasing plunger portion 9*b* such that the pressure increasing plunger portion 9*b* extends downwardly from a center of a lower portion of the guided rod portion 9*a*. The guided rod portion 9*a* is formed with a recessed portion 10 that is an receiving chamber opened upwardly.

The recessed portion 10 is formed with a large diameter chamber 10*a* and a small diameter chamber 10*b*. A step portion 10*c* is formed between a lower end portion of the large diameter chamber 10*a* and an upper end portion of the small chamber 10*b*.

A pressure relief passage 11 is formed to extend downwardly from a central portion of a bottom surface of the recessed portion 10. The pressure relief passage 11 extends along a central axis of the pressure increasing plunger portion 9*b* to reach the lower end surface of the pressure increasing plunger portion 9*b*.

The diameter of the pressure increasing plunger portion 9*b* smaller than the diameter of the guided rod portion 9*a*, and therefore, a hollow portion 12 is defined along the outer side of the circumference of the pressure increasing plunger portion 9*b* in the accommodating chamber 7. The hollow portion 12 is communicated, through a communication hole 13 formed in the lower portion of the guided rod portion 9*a*, with the recessed portion 10. A bypass passage 14 is formed to communicate the lower end portion of the hollow portion 12 with the pressure release portion 3. A pressure increasing piston spring 15 is installed in the hollow portion 12 to bias the pressure increasing piston 9 upwardly of the injector 1.

A pressure relief piston 16, serving as switching means, and a ball valve 17, serving as switching means, are accommodated in the recessed portion 10 formed in the guided rod portion 9*a* of the pressure increasing piston 9.

The pressure relief piston 16 is formed with a large diameter portion 16*a*, an intermediate diameter portion 16*b* and a small diameter portion 16*c*. The large diameter portion 16*a* is accommodated in the large diameter chamber 10*a* of the recessed portion 10, and the intermediate diameter portion 16*b* and the small diameter portion 16*c* are both accommodated in the small diameter chamber 10*b*. The pressure relief piston 16 is attached vertically slidably within the recessed portion 10. The mass of the pressure relief piston 16 is small in comparison with the mass of the pressure increasing piston 9. A pressure relief piston spring 18 is installed at the lower end portion of the intermediate diameter portion 16*b* of the pressure relief piston 16 and outside the small diameter portion 16*c* thereof so as to bias the pressure relief piston 16 upwardly.

The valve 17 is interposed between the lower end surface of the small diameter portion 16*c* of the pressure relief piston 16 and the upper end portion of the pressure relief passage 11.

A fuel pressure increasing chamber 19 is formed below the pressure increasing piston 9. The fuel pressure increasing chamber 19 is communicated with the pressure relief passage 11. The fuel pressure increasing chamber 19 is communicated, through the fuel supplying passage 20, with the fuel supplying portion 21, so that the fuel supplied from the fuel supplying pump 70 to the fuel supplying portion 21 flows into the fuel pressure increasing chamber 19. A check valve 22 is interposed between the fuel pressure increasing chamber 19 and the fuel supplying passage 20. The check valve 22 is moved upwardly when the pressure within the fuel pressure increasing chamber 19 is a predetermined level or more, to interrupt communication between the fuel pressure increasing chamber 19 and the fuel supplying passage 20.

An injection valve 23 is accommodated vertically slidably in a lower portion of the injector 1. The injection valve 23 includes a pressurizing piston portion 23*a*, a large diameter portion 23*b*, a step portion 23*c* and a small diameter portion 23*d*. A pressurizing spring 24 is installed above the pressurizing piston portion 23*a* so as to bias the injection valve 23 downwardly. A fuel filling chamber 25 is formed around the step portion 23*c* of the injection valve 23. In the fuel filling chamber 25, the step portion 23*c* of the injection valve 23 is exposed, so that the pressure within the fuel filling chamber 25 acts on the step portion 23*c* of the injection valve 23 to bias the injection valve 23 upwardly. The fuel filling chamber 25 is communicated, through the fuel passage 26, with the fuel pressure increasing chamber 19. A fuel passage 27 extends downwardly from the fuel filling chamber 25, and an injection port 28 is formed in the vicinity of the leading end portion of the fuel passage 27.

Next, the operation of the injector 1 will be described.

A state prior to the start of fuel injection is shown in FIG. 2. Prior to the start of the fuel injection, the electromagnetic solenoid 4 is non-energized, so that the switch valve 5 is biased by the return spring 6 to be located at a non-injection position where the pressure application chamber 8 is communicated with the pressure release portion 3. As the pressure application chamber 8 is communicated with the pressure release portion 3, the fuel, serving as the operation fluid, within the pressure application chamber 8 flows out toward the pressure release portion 3, and accordingly the pressure within the pressure application chamber 8 is low. As the pressure within the pressure application chamber 8 is low, the pressure increasing piston 9 is shifted upwardly within the accommodating chamber 7, by the action of the spring force of the pressure increasing piston spring 15, that is, the pressure increasing piston 9 is disposed at non-injection position. As the pressure increasing piston 9 is disposed at the non-injection position, the pressure relief piston 16 contacts a wall forming the upper end of the accommodating chamber 7. As the pressure relief piston 16 contacts the wall forming the upper end of the accommodating chamber 7, the ball valve 17 is pressed by the bottom wall of the small diameter portion 16*c* of the pressure relief piston 16 so as to be located at a position where the communication between the pressure relief passage 11 and the recessed portion 10 is interrupted. When the pressure increasing piston 9 is located at non-injection position, that is, at the upper portion within the accommodating chamber 7, the pressure within the fuel pressure increasing chamber 19 is such that a relatively low pressure that is substantially equal to the pressure of the fuel to be supplied to the fuel pressure increasing chamber 19, and the check valve 22 is disposed at a position where the fuel pressure increasing chamber 19 and the fuel supplying passage 20 are communicated with each other. If the pressure within the fuel pressure increasing chamber 19 is low, the pressure within the fuel filling chamber 25 communicated with the fuel pressure increasing chamber 19 is also low. As the pressure within the fuel filling chamber 25 is low, the force acting on the step portion 23*c* of the injection valve 23 is weak, so that the injection valve 23 is disposed, by the action of the spring force of the pressurizing spring 24, at a non-injection position to interrupt the communication between the fuel passage 27 and the injection port 28.

A state at the start of the fuel injection is shown in FIG. 3. To inject the fuel, the electromagnetic solenoid 4 in the injection anterior state of FIG. 2 is energized. As the electromagnet solenoid 4 is energized, the switch valve 5 is disposed, by the action of the attracting force of the electromagnetic solenoid 4, at an injection position where the pressure application chamber 8 and the operation fluid supplying portion 2 are communicated with each other. As the pressure application chamber 8 is communicated with the operation fluid supplying portion 2, the fuel, which is the high pressure operation fluid transmitted from the common rail 67 to the operation fluid supplying portion 2 under pressure, flows into the pressure application chamber 8 to increase the pressure within the pressure application chamber 8. The pressure within the pressure application chamber 8 acts on the apex surface of the pressure relief piston 16 to bias the pressure relief piston 16 downwardly. As the pressure relief piston 16 is biased downwardly, the force thereof is transmitted, through the outer circumferential side lower surface of the large diameter portion 16*a* of the pressure relief piston 16, the lower surface of the ball valve 17 and pressure relief piston spring 18, to the pressure increasing piston 9 so that the pressure increasing piston 9 is biased downwardly.

When the pressure within the pressure application chamber 8 is increased to reach a predetermined level or more, the force biasing the pressure increasing piston 9 downwardly is larger than the force biasing the pressure increasing piston 9 upwardly, i.e. the spring force of the pressure increasing piston spring 15, so that the pressure increasing piston 9 starts to slid downwardly. The pressure relief piston 16 is biased downwardly by the pressure acting on the apex surface of the pressure relief piston 16 and is accommodated within the recessed portion 10. As the pressure relief piston 16 is put into the accommodated state, the ball valve 17 installed below the pressure relief piston 16 is pressurized downwardly so as to be located at a position where the communication between the pressure relief passage 11 and he recessed portion 10 is interrupted.

As the pressure increasing piston 9 is initiated to be slid downwardly, a clearance is formed between the apex surface of the pressure increasing piston 9 and the wall forming the upper end portion of the accommodating chamber 7, so that the fuel within the pressure application chamber 8 flows into the clearance. The fuel flowing into the upper portion of the pressure increasing piston 9 acts on the apex surface of the pressure increasing piston 9 to bias the pressure increasing piston 9 downwardly.

As the pressure increasing piston 9 is slid downwardly, the fuel within the fuel pressure increasing chamber 19 is pressurized, and when the pressure within the fuel pressure increasing chamber 19 is increased to reach a predetermined level or more, the check valve 22 is located at a position where the communication between the fuel pressure increasing chamber 19 and the fuel supplying passage 20 is interrupted.

As the pressure increasing piston 9 is further slid downwardly, the fuel within the fuel pressure increasing chamber 19 is further pressurized, and when the pressure of the fuel within the fuel filling chamber 25 communicated with the fuel pressure increasing chamber 19 reaches a predetermined level or more, the pressure acting on the step portion 23*c* of the injection valve 23 is larger than the spring force of the pressurizing spring 24, so that the injection valve 23 is slid upwardly. As the injection valve 23 is slid upwardly, the fuel passage 27 is made in communication with the injection port 28 so that the fuel is injected from the injection port 28.

A state at the end of the fuel injection is shown in FIG. 4. At the end of the fuel injection, the electromagnetic solenoid 4 in the state of fuel injection shown in FIG. 3 is de-energized. As the electromagnetic solenoid 4 is de-energized, the switch valve 5 is biased by the return spring 6 to be located at the non-injection position where the pressure application chamber 8 is communicated with the pressure release portion 3. As the pressure application chamber 8 is communicated with the pressure release portion 3, the fuel, serving as the operation fluid, within the pressure application chamber 8 flows out from the pressure release portion 3 to the operation fluid recovering device 68, so that the pressure within the pressure application chamber 8 is lowered. As the pressure within the pressure application chamber 8 is low, the pressure acting on the apex surfaces of the pressure relief piston 16 and the pressure increasing piston 9 is reduced. Consequently, the pressure relief piston 16 and the pressure increasing piston 9 are initiated to be slid upwardly by the spring forces of the pressure relief piston spring 18 and the pressure increasing piston spring 15, respectively. Note that since the mass of the pressure relief piston 16 is relatively small in comparison to the mass of the pressure increasing piston 9, the speed of upwardly sliding the pressure relief piston 16 is higher than the speed of upwardly sliding the pressure increasing piston 9. Since the pressure relief piston 16 is higher in upwardly sliding speed than the pressure increasing piston 9, the pressure relief piston 16 protrudes upwardly from the recessed portion 10 formed in the pressure increasing piston 9 upper portion, and the ball valve 17 is upwardly moved by the pressure within the fuel pressure increasing chamber 19, acting on the lower surface of the ball valve 17 and biasing the ball valve 17 upwardly, to be located at the position where the pressure relied passage 11 and the recessed portion 10 are communicated with each other. As the pressure relief passage 11 is communicated with the recessed portion 10, the fuel within the pressure increasing chamber 19 flows out, through the pressure relief passage 11, the recessed portion 10, the communication portion 13, the hollow portion 12 and the bypass passage 14, to the pressure release portion 3, and consequently the pressure within the fuel pressure increasing chamber 19 is lowered. As the pressure within the fuel pressure increasing chamber 19 is lowered, the pressure within the fuel filling chamber 25 communicated with the fuel pressure increasing chamber 19 is also lowered. As the pressure within the fuel filling chamber 25 is lowered so that the pressure acting on the step portion 23*c* of the injection valve 23 reaches a predetermined level of less, the injection valve 23 is slid downwardly to be located at the non-injection position where the communication between the fuel passage 27 and the injection port 28 is interrupted, thereby ending the injection. When the pressure increasing piston 9 is further slid upwardly to be located at the upper, non-injection position within the accommodating chamber 7, the pressure relief piston 16 is biased downwardly by the upper wall forming the upper end of the accommodating chamber 7, so that the pressure relief piston 16 locates the ball valve 17 at a position where the communication between the pressure relief passage 11 and the recessed portion 10 is interrupted. During the course of movement of the pressure increasing piston 9 to be located at the non-injection position, when the pressure within the fuel pressure increasing chamber 19 reaches a predetermined level or less, the check valve 22 is located at a position where the fuel pressure increasing chamber 19 is communicated with the fuel supplying passage 20, so that the fuel is supplied from the fuel supplying portion 21 to the fuel pressure increasing chamber 19. Consequently, the state is returned to the fuel injection anterior state shown in FIG. 2.

Next, features of the common rail type fuel injection device using the pressure increasing type injector 1 constructed above will be described as follows:

(1) The fuel pressure increasing chamber 19 is communicated through the pressure relief passage 11, the recessed portion 10, the hollow portion 12 and the bypass passage 14 with the pressure release portion 3, and at the start of the fuel injection, the communication between the pressure relief passage 11 and the recessed portion 10 is interrupted by the ball valve 17, whereas at the end of the fuel injection, the pressure relief passage 11 is brought into communication with the recessed portion 10.

Consequently, since the fuel is pressurized at the start of the fuel injection similar to the related pressure increasing type injector, the injection ratio at the start of the fuel injection can be increased gently.

At the end of the fuel injection, the fuel within the fuel pressure increasing chamber 19 is allowed to flow out to the pressure release portion 3, so that the pressure within the fuel pressure increasing chamber 19 can be rapidly lowered. Accordingly, the pressure within the fuel filling chamber 25 communicated with the fuel pressure increasing chamber 19 can be rapidly lowered to rapidly slide the injection valve 23 downwardly, thereby ending the injection. Consequently, the injection ratio can be lowered abruptly.

(2) The pressure relief piston 16, serving as the switching means, is controlled by the pressure of the operation fluid, and therefore new additional drive means need not be provided to control the pressure relief piston 16 serving as the switching means. Consequently, it is possible to avoid the increase in size of the injector 1 associated with the provision of the new additional drive means.

(3) The pressure relief piston 16 serving as the switching means is disposed within the recessed portion 10 formed as the accommodating portion within the pressure increasing piston 9. Therefore, the pressure relief piston 16 does not occupy the space, and it is possible to avoid the increase in size of the injector 1 in comparison with the related injector.

(4) The control for the injector 1 is realized by the one electromagnetic solenoid 4 and the one switch valve 5. Accordingly, since the number of components is small in comparison with the related injector using one electromagnetic solenoid for controlling two valves, the injector 1 is small in size and reliable in operation.

(5) Since the injection is ended by allowing the fuel to flows out from the fuel pressure increasing chamber 19 to the pressure release portion 3, it is unnecessary to make strong the spring force of the pressurizing spring 24 for interrupting the communication between the fuel passage 27 and the injection port 28. Consequently, the spring force of the pressurizing spring 24 can be made small, thereby eliminating the damage on the leading end portion of the injection valve 23.

Embodiment 2

Next, a second embodiment which embodies the present invention as a common rail type fuel injecting device used in a diesel engine will be described with reference to FIGS. 1 and 5. Components in the second embodiment are the same reference numerals as the components in the first embodiment, and therefore will not described again.

In the present embodiment, the fuel injection device 60 shown in FIG. 1 employs an injector 40 in place of the injector 1 used in the first embodiment.

A pressure increasing piston 41 built in the injector 40 is designed so that a pressure increasing plunger 41*b* extends downwardly from a center of the lower portion of a guided rod portion 41*a*. In the present embodiment, no recessed portion is formed in the upper portion of the guided rod portion 41*a*.

On the right side of the pressure increasing piston 41, a bypass passage 42 is formed for communicating the fuel pressure increasing chamber 19 with the pressure release portion 3. In the present embodiment, the switch valve 5 is used as the switching means, so that communication between the bypass passage 42 and the pressure relief portion 3 is interrupted by the switch valve 5.

In contrast to the first embodiment in which the fuel supplying passage 20, the fuel supplying portion 21, the check valve 22 and the fuel passage 26 are disposed in the right side of the injector 1, the present embodiment is designed such that corresponding fuel supplying passage 46, fuel supplying portion 47, check valve 48 and fuel passage 49 are disposed in the left side of the injector 40.

This is merely because a area for forming the bypass passage 42 is secured, and functions of these components are similar to those of the corresponding components in the first embodiment.

Next, the operation of the injector 40 will be described.

Figure 5:
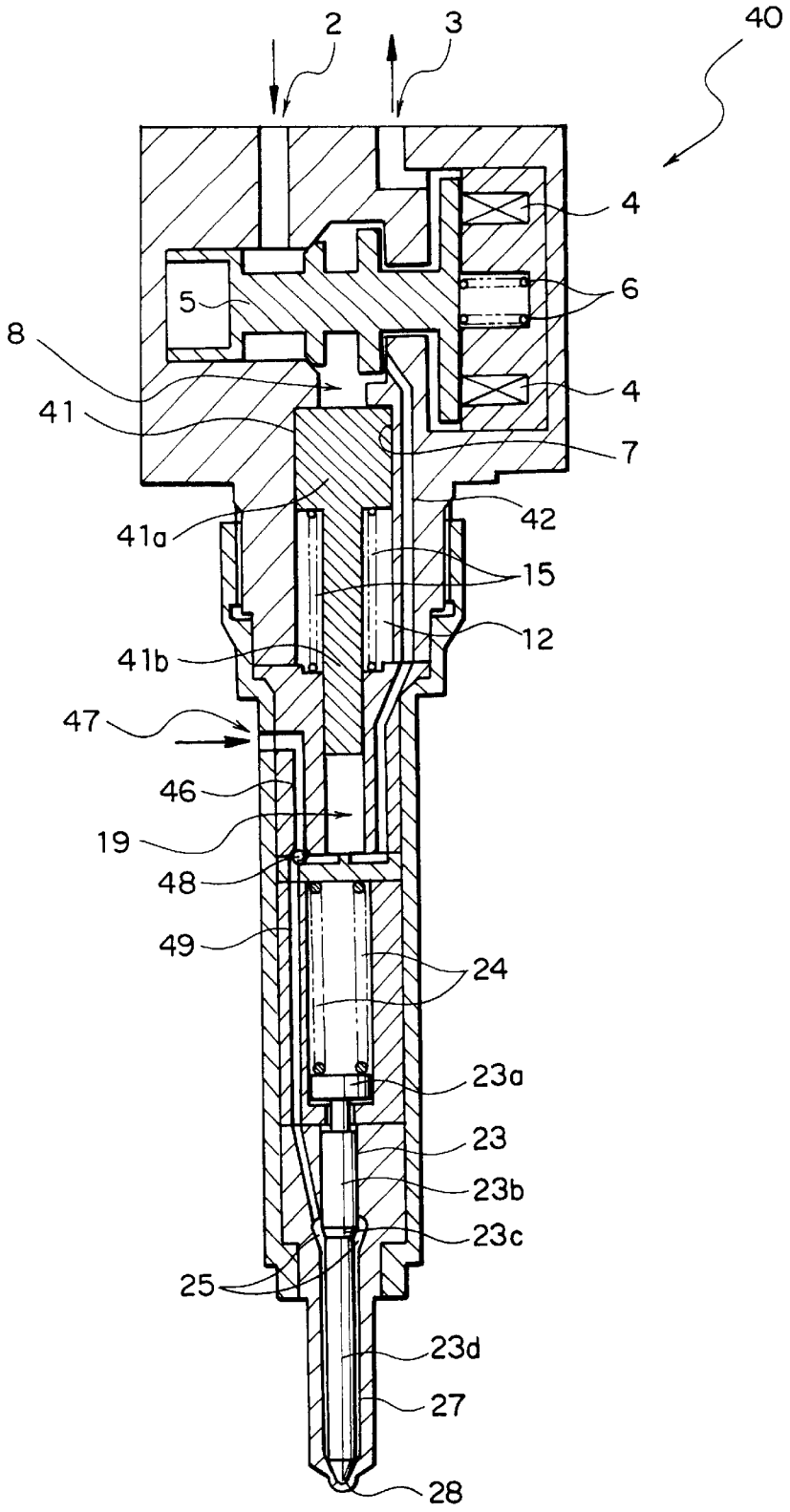
FIG. 5 is a sectional view of an injector, for explaining a second embodiment.

Prior to the start of the fuel injection, the electromagnetic solenoid 4 is non-energized, so that, as shown in FIG. 5, the switch valve 5, serving as the switching means, is located at a non-injection position where the pressure application chamber 8 is communicated with the pressure release portion 3. As the switching valve 5 is located at the non-injection position, the bypass passage 42 and the pressure release portion 3 is brought into communication with each other. Since the pressure application chamber 8 is communicated with the pressure release portion 3, the pressure within the pressure application chamber 8 is low, so that the pressure increasing piston 41 is located at a non-injection position shown in FIG. 5, and the injection valve 23 is located at a non-injection position where the communication between the fuel passage 27 and the injection port 28 is interrupted.

As the start of the injection, the electromagnetic solenoid 4 is energized, so that the switch valve 5 is located at an injection position to communicate the pressure application chamber 8 with the operation fluid supplying portion 2. As the switch valve 5 is located at the injection position, the communication between the bypass passage 42 and the pressure release portion 3 is interrupted by the switch valve 5. Since the pressure application chamber 8 is in communication with the operation fluid supplying portion 2, the pressure within the pressure application chamber 8 is increased. Consequently, the pressure increasing piston 41 is initiated to be slid downwardly to pressurize the fuel within the fuel pressure increasing chamber 19. As the fuel within the fuel pressure increasing chamber 19 is pressurized, the pressure within the fuel filling chamber 25 is increased, so that the injection valve 23 is slid upwardly to be located at an injection position. As the injection valve 23 is located at the injection position, the fuel passage 27 is brought into communication with the fuel port 28, so that the fuel is injected from the fuel port 28.

At the end of fuel injection, the electromagnetic solenoid 4 is de-energized, so that the switch valve 5 is located at the non-injection position to communicate the pressure application chamber 8 with the pressure release portion 3. As the switch valve 5 is located at the non-injection position, the bypass passage 42 is communicated with the pressure release portion 3, so that the fuel within the fuel pressure increasing chamber 19 flows through the bypass passage 42 out of the pressure release portion 3. As the fuel within the fuel pressure increasing chamber 19 flows out to lower the pressure within the fuel pressure increasing chamber 19, the pressure within the fuel filling chamber 25 is also lowered. Consequently, the injection valve 23 is slid downwardly to be located at the non-injection position where the communication between the fuel passage 27 and the injection port 28 is interrupted, thereby ending the injection.

Next, features of the common rail type fuel injection device 60 employing the pressure increasing type injector 40 thus constructed will be described as follows:

(1) The fuel pressure increasing chamber 19 is communicated through the bypass passage 42 with the pressure release portion 3, and at the start of the fuel injection, the communication between the fuel pressure increasing chamber 19 and the pressure release portion 3 is interrupted by the switch valve 5, whereas at the end of the fuel injection, the fuel pressure increasing chamber 19 is brought into communication with the pressure release portion 3.

Consequently, since the fuel is pressurized at the start of the fuel injection similar to the related pressure increasing type injector, the injection ratio at the start of the fuel injection can be increased gently.

At the end of the fuel injection, the high pressure fuel within the fuel pressure increasing chamber 19 is allowed to flow out to the pressure release portion 3, so that the pressure within the fuel pressure increasing chamber 19 can be rapidly lowered. Accordingly, the pressure within the fuel filling chamber 25 communicated with the fuel pressure increasing chamber 19 can be rapidly lowered to rapidly slide the injection valve 23 downwardly, thereby ending the injection. Consequently, the injection ratio can be lowered abruptly.

(2) The switch valve 5, serving as the switching means, is driven by energizing the electromagnetic solenoid 4, and consequently, it is possible to avoid the increase in size of the injector 1 associated with the provision of new additional drive means.

(3) The control for the injector 1 is realized by the one electromagnetic solenoid 4 and the one switch valve 5. Accordingly, since the number of components is small in comparison with the related injector using one electromagnetic solenoid for controlling two valves, the injector 1 is small in size and reliable in operation.

(4) Since the injection is ended by allowing the fuel to flow out from the fuel pressure increasing chamber 19 to the pressure release portion 3, it is unnecessary to make strong the spring force of the pressurizing spring 24 for interrupting the communication between the fuel passage 27 and the injection port 28. Consequently, the spring force of the pressurizing spring 24 can be made small, thereby eliminating the damage on the leading end portion of the injection valve 23.

(5) The first embodiment employs the pressure relief piston 16 built in the injector 1 as the switching means, but the present embodiment employs the switch valve 5 which has originally been built in as the switching means, and therefore the number of components can be reduced, and the operation can be made reliable.

Embodiment 3

A third embodiment, which embodies the present invention as the common rail type fuel injection device used in the diesel engine will be described with reference to FIGS. 1 and 6. Components in the third embodiment are the same reference numerals as the components in the first and second embodiments, and will not be described again.

In the present embodiment, the fuel injection device 60 shown in FIG. 1 employs an injector 50 in place of the injector 1 used in the first embodiment.

Figure 6:
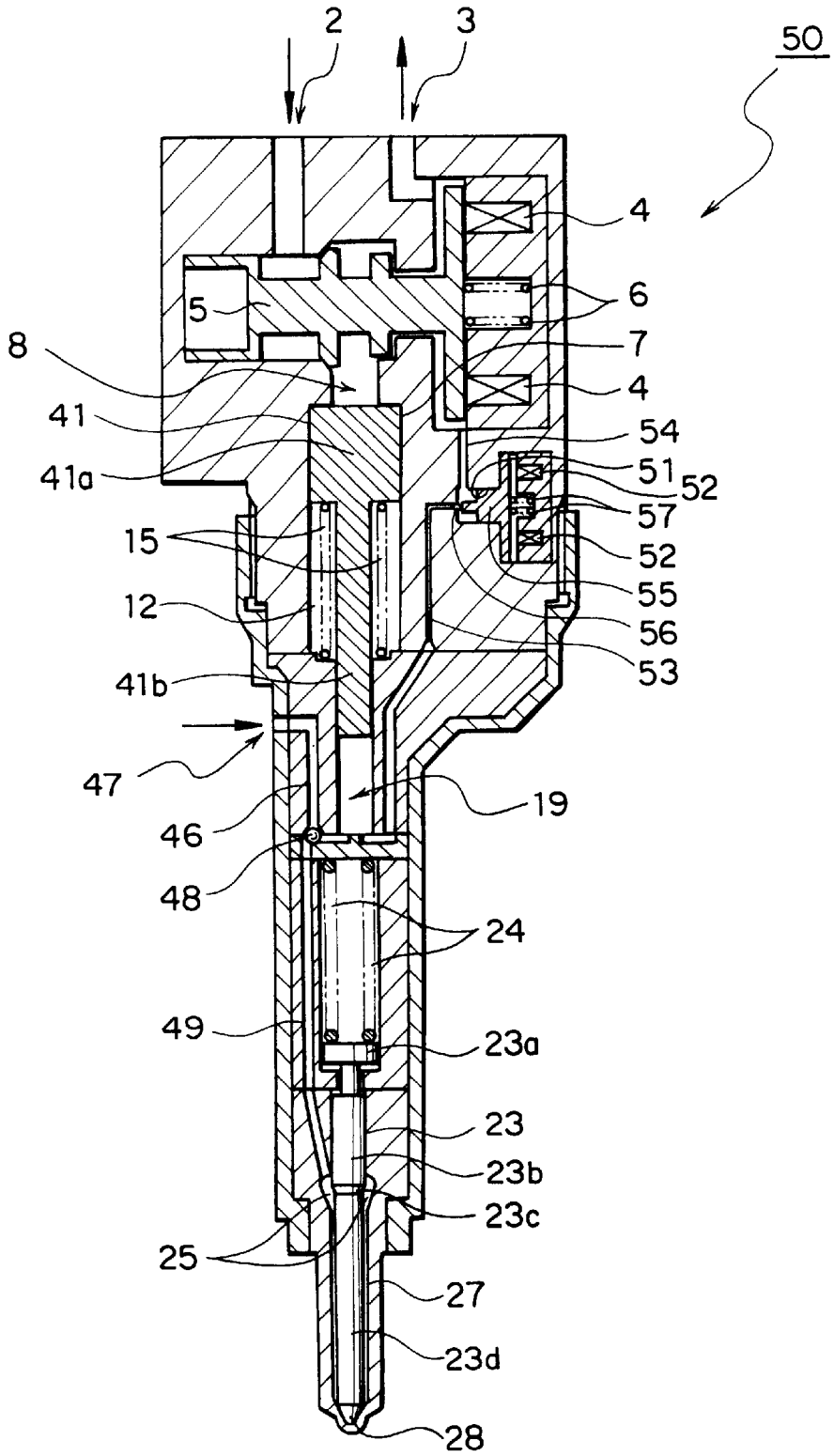
FIG. 6 is a sectional view of an injector, for explaining a third embodiment.

As shown in FIG. 6, in the right side of the pressure increasing piston 41 built in the injector 50, a second accommodating chamber 51 is formed. In the right side of the second accommodating chamber 51, a second electromagnetic solenoid 52 is disposed.

The second accommodating chamber 51 is communicated with the fuel pressure increasing chamber 19 by a pressure relief passage 53. The second accommodating chamber 51 is communicated with the pressure release portion 3 by a bypass passage 54.

The second accommodating chamber 51 accommodates therein a second return spring 57, a ball valve 56 and a pressure relief valve 55, which serve as the switching means.

The pressure relief valve 55 is attached slidably. The pressure relief valve 55 receives an attraction force by energizing the second electromagnetic solenoid 52, and is biased by the second return spring 57 in a direction away from the second electromagnetic solenoid 52.

The ball valve 56 is disposed between the leading end portion of the pressure relief valve 55 and the end portion of the pressure relief passage 53.

Next, the operation of the injector 50 will be described.

Prior to the start of the fuel injection, the electromagnetic solenoid 4 and the second electromagnetic solenoid 52 are both non-energized, so that as shown in FIG. 6 the switch valve 5 is disposed at a non-injection position where the pressure application chamber 8 is communicated with the pressure release portion 3. As the pressure application chamber 8 is communicated with the pressure release portion 3, the pressure within the pressure application chamber 8 is low, so that the pressure increasing piston 41 is upwardly biased by the spring force of the pressure increasing piston spring 15, and is located at a non-injection position. The pressure relief valve 55 is biased in the direction away from the second electromagnetic solenoid 52 by the spring force of the second return spring 57. As the pressure relief valve 55 is biased in the direction away from the second electromagnetic solenoid 52, the pressure relief valve 55 pressurizes the ball valve 56 to be located at a position where the communication between the pressure relief passage 53 and the second accommodating chamber 51 is interrupted. As the pressure increasing piston 41 is located at a non-injection position, the fuel pressure increasing chamber 19, not pressurized by the pressure increasing piston 41, is relatively low in pressure, and therefore the pressure within the fuel filling chamber 25 communicated with the fuel pressure increasing chamber 19 is also relatively low. Consequently, the injection valve 23 is located at a non-injection position where the communication between the fuel passage 27 and the injection port 18 is interrupted.

At the start of the injection, the electromagnetic solenoid 4 is energized. Note that the second electromagnetic solenoid 52 is maintained non-energized. As the electromagnetic solenoid 4 is energized, the pressure increasing piston 41 is slid downwardly to pressurize the fuel within the fuel pressure increasing chamber 19. As the fuel within the fuel pressure increasing chamber 19 is pressurized to increase the pressure, the pressure within the fuel filling chamber 25 communicated with the fuel pressure increasing chamber 19 is also increased. As the pressure within the fuel filling chamber 25 is increased, the injection valve 23 is slid upwardly so as to be located at an injection position where the fuel passage 27 is brought into communication with the fuel port 28, so that the fuel is injected.

At the end of fuel injection, the electromagnetic solenoid 4 is de-energized, and the second electromagnetic solenoid 52 is energized. As the second electromagnetic solenoid 52 is energized, the pressure relief valve 55 is slid in a direction toward the second electromagnetic solenoid 52. As the pressure relief valve 55 is slid in the direction toward the second electromagnetic solenoid 52, the ball valve 56 is disposed at a position where the pressure relief passage 53 is communicated with the second accommodating chamber 51, by the pressure within the fuel pressure increasing chamber 19 via the pressure relief passage 53. As the pressure relief passage 53 is communicated with the second accommodating chamber 51, the fuel within the fuel pressure increasing chamber 19 flows through the pressure relief passage 53, the second accommodating chamber 51 and the second bypass passage 54 out of the pressure release portion 3. As the fuel within the fuel pressure increasing chamber 19 flows out of the pressure release portion 3, the pressure within the fuel pressure increasing chamber 19 is lowered while the pressure within the fuel filling chamber 25 is also lowered, so that the injection valve 23 interrupts the communication between the fuel passage 27 and the injection port 28, thereby ending the fuel injection.

Next, features of the common rail type fuel injection device 60 using the pressure increasing type injector 50 thus constructed will be described.

(1) The fuel pressure increasing chamber 19 is communicated through the pressure relief passage 53, the second accommodating chamber 51 the second bypass passage 54 with the pressure release portion 3, and at the start of the fuel injection, the communication between the pressure relief passage 53 and the second accommodating chamber 51 is interrupted by the ball valve 56, whereas at the end of the fuel injection, the pressure relief passage 53 is brought into communication with the second accommodating chamber 51.

Consequently, since the fuel is pressurized at the start of the fuel injection similar to the related pressure increasing type injector, the injection ratio at the start of the fuel injection can be increased gently.

At the end of the fuel injection, the fuel within the fuel pressure increasing chamber 19 is allowed to flow out to the pressure release portion 3, so that the pressure within the fuel pressure increasing chamber 19 can be rapidly lowered. Accordingly, the pressure within the fuel filling chamber 25 communicated with the fuel pressure increasing chamber 19 can be rapidly lowered to rapidly slide the injection valve 23 downwardly, thereby ending the injection. Consequently, the injection ratio can be lowered abruptly.

(2) Since the injection is ended by allowing the fuel to flows out from the fuel pressure increasing chamber 19 to the pressure release portion 3, it is unnecessary to make strong the spring force of the pressurizing spring 24 for interrupting the communication between the fuel passage 27 and the injection port 28. Consequently, the spring force of the pressurizing spring 24 can be made small, thereby eliminating damage to the leading end portion of the injection valve 23.

(3) Since the pressure relief valve 55 serving as the switching means is activated by the second electromagnetic solenoid 52, the operation is reliable.

Embodiment 4

A fourth embodiment, which embodies the present invention as the common rail type fuel injecting device used in the diesel engine will be described with reference to FIGS. 1 and 7. Components the same as the components which have been described in connection with the first to third embodiments are denoted by the same reference numerals, and will not be described again.

In the present embodiment, the fuel injecting device 60 shown in FIG. 1 employs an injector 80 in place of the injector 1 used in the first embodiment.

Figure 7:
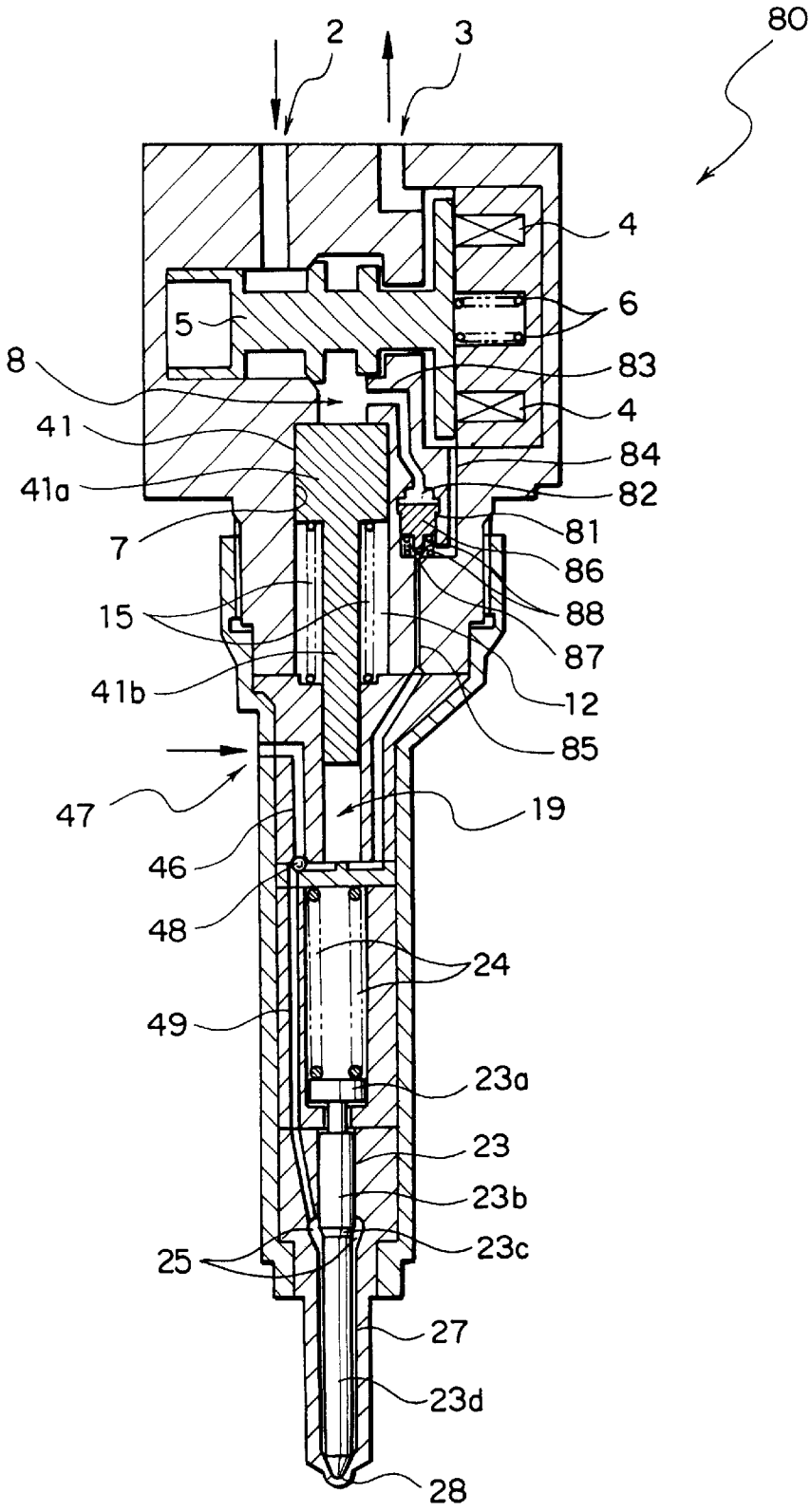
FIG. 7 is a sectional view of an injector, for explaining a fourth embodiment.
Figure 8:
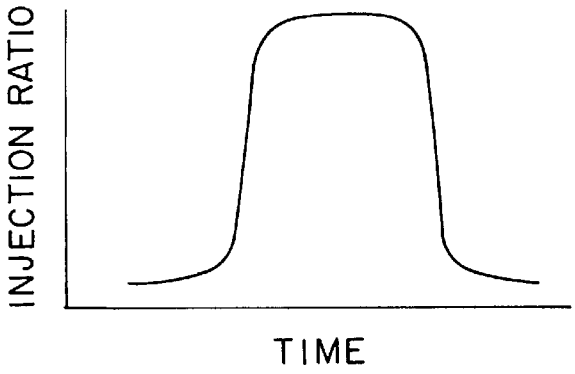
FIG. 8 is a diagram showing a fuel injection ratio in a related pressure increasing type injector.
Figure 9:
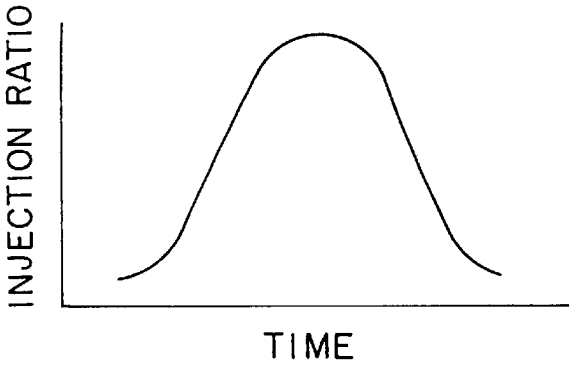
FIG. 9 is a diagram showing a fuel injection ratio in a related pressure charging type injector.
Figure 10:
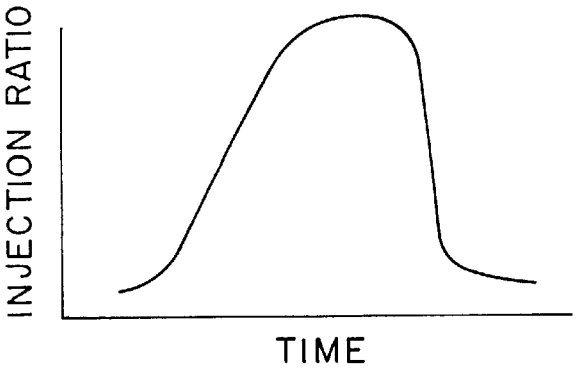
FIG. 10 is a diagram showing a fuel injection ratio to be realized by the present invention.

As shown in FIG. 7, in the right side of the pressure increasing piston 41 built in the injector 80, a second accommodating chamber 81 is formed.

Above the second accommodating chamber 81, a second pressure application chamber 82 is formed so that the second pressure application chamber 82 is communicated with the second accommodating chamber 81. A communication passage 83 is formed to communicate the upper end portion of the second pressure application chamber 82 with the pressure application chamber 8 above the pressure increasing piston 41. A bypass passage 84 is formed to communicate the lower side portion of the second accommodating chamber 81 with the pressure release portion 3. Further, a pressure relief passage 85 is formed to communicate the bottom surface center of the second accommodating chamber 81 with the fuel pressure increasing chamber 19.

Accommodated within the second accommodating chamber 81 are a pressure relief piston 86 serving as the switching means and a ball valve 87 serving as the switching means. The pressure relief piston 86 is attached vertically slidably within the second accommodating portion 81. A pressure relief piston spring 88 is installed in the lower side portion of the pressure relief piston 86 so as to bias the pressure relief piston 86 upwardly. A ball valve 87 is installed below the pressure relief piston 86 to be interposed between the lower end surface of the pressure relief piston 86 and the upper end portion of the pressure relief passage 85.

Next, the operation of the injector 80 will be described.

At the start of the fuel injection, the electromagnetic solenoid 4 is de-energized, so that as shown in FIG. 7 the switch valve 5 is located at a non-injection position where the pressure application chamber 8 is communicated with the pressure release portion 3. As the pressure application chamber 8 is communicated with the pressure release portion 3, the pressure within the pressure application chamber 8 is low, so that the pressure increasing piston 41 is biased upwardly by the spring force of the pressure increasing piston spring 15 to be located at a non-injection position. As the pressure within the pressure application chamber 8 is low, the pressure within the second pressure application chamber 82 communicated with the pressure application chamber 8 is also low, so that the pressure relief piston 86 is biased upwardly by the spring force of the pressure relief piston spring 88. As the pressure increasing piston 41 is disposed at the non-injection position, the pressure within the fuel pressure increasing chamber 19 not pressurized by the pressure increasing piston 41 is relatively low, so that the pressure within the fuel filling chamber 25 communicated with the fuel pressure increasing chamber 19 is also relatively low. Consequently, the injection valve 23 is located at a non-injection position where the communication between the fuel passage 27 and the injection port 28 is interrupted.

At the start of the fuel injection, the electromagnetic solenoid 4 is energized. As the electromagnetic solenoid 4 is energized, the switch valve 8 is disposed at an injection position where the pressure application chamber 5 is communicated with the operation fluid supplying portion 2. As the pressure application chamber 8 is communicated with the operation fluid supplying portion 2, the pressure within the pressure application chamber 8 is increased. The pressure within the second pressure application chamber 82 communicated with the pressure application chamber 8 is also increased.

As the pressure within the second pressure application chamber 82 is increased, the pressure relief piston 86 is biased downwardly, and the ball valve 87 is pressurized downwardly by the pressure relief piston 86, so that the ball valve 87 is located at a position where the communication between the pressure relief passage 85 and the second accommodating chamber 81 is interrupted.

As the pressure within the pressure application chamber 8 is increased, the pressure increasing piston 41 is initiated to be slid downwardly to pressurize the fuel within the fuel pressure application chamber 19. As the fuel within the fuel pressure increasing chamber 19 is pressurized, the pressure within the fuel filling chamber 25 communicated with the fuel pressure increasing chamber 19 is also increased so as to bias the injection valve 23 upwardly. Consequently, the injection valve 23 is located at an injection position where the fuel passage 27 is communicated with the injection port 28, thereby injecting the fuel.

At the end of the fuel injection, the electromagnetic solenoid 4 is de-energized. As the electromagnetic solenoid 4 is de-energized, the switch valve 5 is located at the non-injection position where the pressure application chamber 8 is communicated with the pressure release portion 3. As the pressure application chamber 8 is communicated with the pressure release portion 3, the pressure within the pressure application chamber 8 is relatively low. As the pressure within the pressure application chamber 8 is relatively low, the pressure within the second pressure application chamber 82 which is in communication with the pressure application chamber 8 is also relatively low, so that the pressure relief piston 86 is biased upwardly by the spring force of the pressure relief piston spring 88, and the ball valve 87 located below the pressure relief piston 86 is biased upwardly by the pressure acting on the lower surface of the ball valve 87, i.e. the pressure within the fuel pressure increasing chamber 19, to be located at the position where the pressure relief passage 85 is communicated with the second accommodating chamber 81. As the pressure relief passage 85 is communicated with the second accommodating chamber 81, the fuel within the fuel pressure increasing chamber 19 flow through the pressure relief passage 85, the second accommodating chamber 81 and the bypass passage 84 out of the pressure release portion 3, so that the pressure within the fuel pressure increasing chamber 19 is lowered. As the pressure within the fuel pressure increasing chamber 19 is lowered, the pressure within the fuel filling chamber 25 communicated with the fuel pressure increasing chamber 19 is also lowered. Consequently, the injection valve 23 is located at the position where the communication between the fuel passage 27 and the injection port 28 is interrupted, thereby ending the fuel injection.

Next, features of the common rail type fuel injecting device 60 employing the pressure increasing type injector 80 thus constructed will be described below.

(1) The fuel pressure increasing chamber 19 is communicated through the pressure relief passage 85, the second accommodating chamber 81, and the bypass passage 84 with the pressure release portion 3, and at the start of the fuel injection, the communication between the fuel pressure increasing chamber 19 and the pressure release portion 3 is interrupted by the pressure relief piston 86, whereas at the end of the fuel injection, the fuel pressure increasing chamber 19 is brought into communication with the pressure release portion 3.

Consequently, since the fuel is pressurized at the start of the fuel injection similar to the related pressure increasing type injector, the injection ratio at the start of the fuel injection can be increased gently.

At the end of the fuel injection, the high pressure fuel within the fuel pressure increasing chamber 19 is allowed to flow out to the pressure release portion 3, so that the pressure within the fuel pressure increasing chamber 19 can be rapidly lowered. Accordingly, the pressure within the fuel filling chamber 25 communicated with the fuel pressure increasing chamber 19 can be rapidly lowered. The injection valve 23 is rapidly slid downwards, to end the injection, so that the fuel injection ratio can be lowered abruptly.

(2) The pressure relief piston 86, serving as the switching means, is activated by the pressure of the operation fluid, and therefore new additional drive means need not be provided to control the pressure relief piston 86 serving as the switching means. Consequently, it is possible to avoid the increase in size of the injector 80 associated with the provision of the new additional drive means.

(3) The control for the injector 80 is realized by the one electromagnetic solenoid 4 and the one switch valve 5. Accordingly, since the number of components is small in comparison with the related injector using one electromagnetic solenoid for controlling two valves, the injector 80 is small in size and reliable in operation.

(4) Since the injection is ended by allowing the fuel to flow out from the fuel pressure increasing chamber 19 to the pressure release portion 3, it is unnecessary to make strong the spring force of the pressurizing spring 24 for interrupting the communication between the fuel passage 27 and the injection port 28. Consequently, the spring force of the pressurizing spring 24 can be made small, thereby eliminating damage to the leading end portion of the injection valve 23.

The present invention should not be restricted to or by the aforementioned embodiments, and may be put into practice in the following manners.

Figure 11:
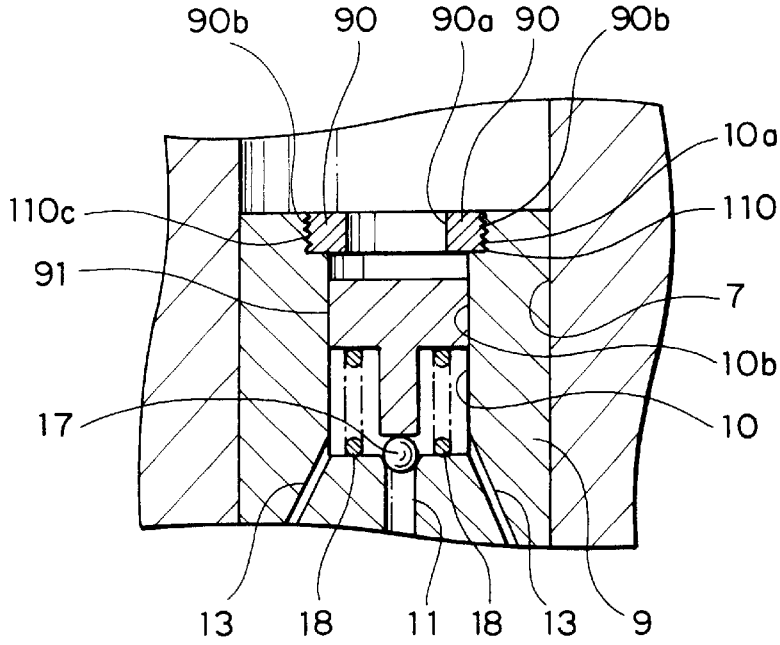
FIG. 11 a diagram relating to another embodiment of the present invention and showing a case where the fuel above the pressure increasing piston is high in pressure.
Figure 12:
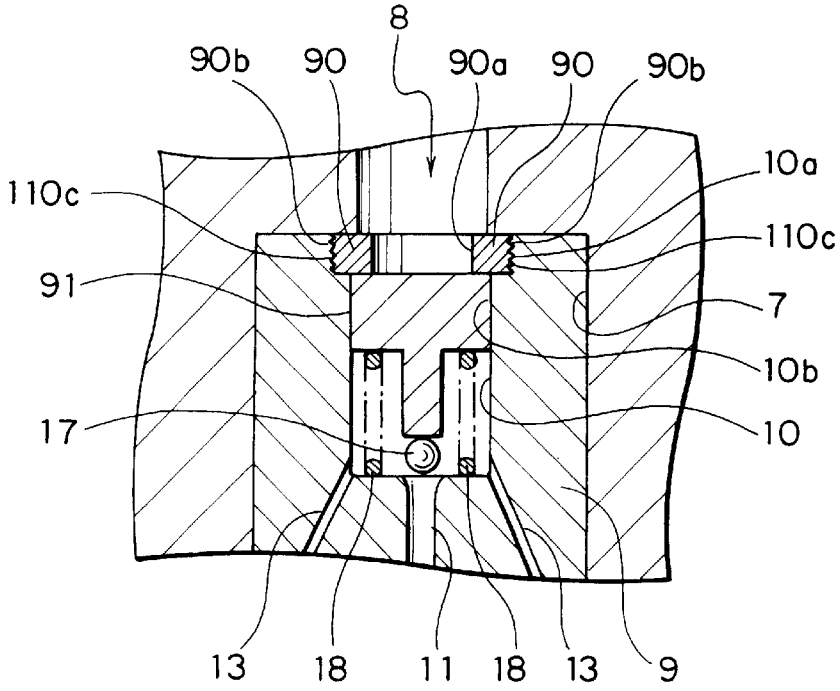
FIG. 12 is a diagram relating to said another embodiment, and showing a case where the fuel above the pressure increasing piston is low in pressure.

In the first embodiment, a member for restricting the upward movement of the pressure relief piston 16 is not provided particularly, but, for example, as shown in FIGS. 11 and 12, such a restricting member 90 may be provided.

In more detail, the pressure relief piston 91 is formed to have such a size as to be accommodated within the small diameter chamber 10*b* of the recessed portion 10. In the large diameter chamber 10*a* above the small diameter chamber 10*b*, the restricting member 90 is disposed, which is formed to have such a size as to be in conformity with the large diameter chamber 10*a*. In this case, in the circumferential surface of the large diameter chamber 10*a* is formed with threads 110*c*, and the outer circumferential portion of the restricting member 90 is formed with threads 90*b* mating the threads 110*c*, so that the restricting member 90 is fixed to the large diameter chamber 10*a* by threading engagement therebetween. The restricting member 90 is formed with a penetrating hole 90*a* which communicates the small diameter chamber 10*b* with a space above the pressure increasing piston 9.

With this arrangement, as shown in FIG. 11 in a case where the fuel flowing into the space above the pressure increasing piston 9 and serving as the operation fluid is high in pressure, the pressure relief piston 91 is biased downwardly by the pressure of the fuel. In a case where the fuel above the pressure increasing piston 9 is low in pressure, the pressure relief piston 91 is biased upwardly by the spring force of the pressure relief piston spring 18, so that as shown in FIG. 12 the pressure relief piston 91 contacts the restricting member 90.

Consequently, the upward movement of the pressure relief piston 91 is restricted by the restricting member 90, thereby preventing removal of the pressure relief piston 91 upwardly beyond the interior of the recessed portion 10.

What is claimed is:

1. A common rail type fuel injecting device for an internal combustion engine, comprising:

a common rail receiving operation fluid; and an injector having a pressure application chamber and a fuel pressure increasing chamber at both ends of a pressure increasing piston, in which at a start of fuel injection, the operation fluid charged in the common rail flows therefrom into the pressure application chamber to bias the pressure increasing piston and pressurize fuel within the fuel pressure increasing chamber, thereby injecting the fuel, whereas at an end of the fuel injection, the operation fluid within the pressure application chamber flows out therefrom to end pressure application to the fuel within the fuel pressure increasing chamber using the pressure increasing piston, thereby ending the fuel injection, said injector being provided with a passage through which the fuel within the fuel pressure increasing chamber flows out externally and switching means for interrupting communication of the passage at the start of the injection, and establishing the communication of the passage at the end of the injection, said switching means being controlled by the operation fluid that flows into the injector.

2. A common rail type fuel injecting device according to claim 1, in which the passage is formed within the pressure increasing piston, and the switching means is disposed within the pressure increasing piston.

3. A common rail type fuel injecting device for an internal combustion engine, comprising:

a common rail receiving operation fluid; and an injector having a pressure application chamber and a fuel pressure increasing chamber at both ends of a pressure increasing piston, in which at a start of fuel injection, the operation fluid charged in the common rail flows therefrom into the pressure application chamber to bias the pressure increasing piston and pressurize fuel within the fuel pressure increasing chamber, thereby injecting the fuel, whereas at an end of the fuel injection, the operation fluid within the pressure application chamber flows out therefrom to end pressure application to the fuel within the fuel pressure increasing chamber using the pressure increasing piston, thereby ending the fuel injection, said injector being provided with a passage through which the fuel within the fuel pressure increasing chamber flows out externally and switching means for interrupting communication of the passage at the start of the injection, and establishing the communication of the passage at the end of the injection, said switching means including a switch valve that selectively communicates the pressure application chamber with either an operation fluid supplying portion or a pressure release portion.

4. A common rail type fuel injecting device according to claim 1, in which the switching means includes pressure relief means provided outside the pressure increasing piston.

5. A common rail type fuel injecting device according to claim 2, in which the passage includes a pressure relief passage and a bypass passage which are mutually communicated with and interrupted from each other by a ball valve.

6. A common rail type fuel injecting device according to claim 3, in which the injector is controlled by one solenoid and one switch valve.

* * * * *

UNITED STATES PATENT AND TRADEMARK OFFICE

CERTIFICATE OF CORRECTION

PATENT NO. : 6,526,942 B2
DATED : March 4, 2003
INVENTOR(S) : Kuzuyama

It is certified that error appears in the above-identified patent and that said Letters Patent is hereby corrected as shown below:

Column 2,
Line 57, please delete "FIG. 11 a diagram" and insert therefore -- FIG. 11 is a diagram --;

Column 6,
Line 36, please delete "he recessed" and insert therefore -- the recessed --;

Column 7,
Line 32, please delete "relied" and insert therefore -- relief --.

Signed and Sealed this

Thirtieth Day of September, 2003

JAMES E. ROGAN
*Director of the United States Patent and Trademark Office*